US006001546A

United States Patent [19]

Suzuki et al.

[11] Patent Number: 6,001,546

[45] Date of Patent: Dec. 14, 1999

[54] MANUFACTURING METHOD FOR SOLID PROCESSING COMPOSITION FOR PROCESSING SILVER HALIDE LIGHT-SENSITIVE PHOTOGRAPHIC MATERIAL

[75] Inventors: Tetsuya Suzuki; Kouki Kawashima; Shinji Uchihiro; Akira Tanizaki, all of Hino, Japan

[73] Assignee: Konica Corporation, Japan

[21] Appl. No.: 09/184,098

[22] Filed: Oct. 30, 1998

[30] Foreign Application Priority Data

Nov. 5, 1997 [JP] Japan ..... 9-302717

[51] Int. Cl.[6] ..... G03C 5/30

[52] U.S. Cl. ..... 430/458; 430/465

[58] Field of Search ..... 430/458, 465

[56] References Cited

U.S. PATENT DOCUMENTS

| | | | |
|---|---|---|---|
| 5,135,840 | 8/1992 | Reuter et al. | 430/465 |
| 5,607,822 | 3/1997 | Deguchi | 430/465 |
| 5,804,358 | 9/1998 | Komatsu et al. | 430/465 |
| 5,900,355 | 5/1999 | Gamble et al. | 430/465 |

*Primary Examiner*—Hoa Van Le

*Attorney, Agent, or Firm*—Jordan B. Bierman; Bierman, Muserlian and Lucas

[57] ABSTRACT

A manufacturing method for a solid processing composition for processing a silver halide photographic light sensitive material, wherein the composition is manufactured by using a stirring granulation method, and at least part of said stirring granulation is performed in the temperature range of 35° C. to 120° C.

The manufacturing method for the solid processing composition mentioned above, wherein the content of the added solution in the stirring granulation process is 0.01 to 2.0 weight % of the total weight of said solid processing composition and wherein not less than 60% of the total weight of said solid processing composition has particle size of 1.0 $\mu$m to 150 $\mu$m.

The solid processing composition mentioned above may contain reductone derivative, sugar derivative and polyethylene glycol derivative.

17 Claims, No Drawings

MANUFACTURING METHOD FOR SOLID PROCESSING COMPOSITION FOR PROCESSING SILVER HALIDE LIGHT-SENSITIVE PHOTOGRAPHIC MATERIAL

FIELD OF THE INVENTION

The present invention relates to a manufacturing method for a solid processing composition for processing a silver halide light sensitive photographic material, particularly to providing a manufacturing method for a solid developing composition.

BACKGROUND OF THE INVENTION

Photographic silver halide materials are generally exposed imagewisely, developed, fixed, washed with water, and then dried, thereby the photographic image is finally observed.

The processing composition used in these process are provided as concentrated solution kits, thereafter these kits are diluted when practically used as working solutions. The concentrated solution kits have an advantage from the viewpoint of excellent solubility, moreover, since there can be wide range of selection of agents including liquid state raw materials, thereby the concentrated solution kits are prepared at less burden in manufacturing processes and at low manufacturing cost.

However, the concentrated solution kits have some dangerous problem such as a contact with skin. Especially the problem becomes more serious when these kits penetrate into eyes. Moreover, the kits must need heavy plastic bottles to contain them. Excessive weight and large volume of processing vessels not only causes increasing transportation cost but also environmentally unacceptable problem with large amount of disposal of the waste vessels.

Accordingly, from the viewpoint of small light weight and compact, the processing composition in the kits is preferably a solid such as a powder form, a granule form, and a tablet form.

However, as mentioned above, compared with a liquid form, a solid form has a big problem in manufacturing cost because it must be passed through various processes, namely, process of measuring raw materials, mixing process, pulverizing process, granulating process, drying process, and dressing process, furthermore, in the case of a tablet form, compressed tableting process is included.

Accordingly, to supply the solid form to the market at similar price to that of the liquid form, there exists the subject that attains to lower the manufacturing cost of the solid form. On the other hand, there is a problem of the deterioration of the properties of the solid processing composition, such as the occurrence of dust, the lowering of it's stability, and the lowering of it's solubility.

SUMMARY OF THE INVENTION

An object of the invention is to provide a manufacturing method for a solid processing composition with a large cut down of manufacturing cost, further, to provide a manufacturing method for a solid developing composition with a preferable handling property, namely, a solid developing composition with improved solubility, with stability in the manufacturing step, and with stability with the passage of time.

DETAILED DESCRIPTION OF THE INVENTION

Above object of the present invention can be accomplished by the following constitutions:

1. A method for manufacturing a solid processing composition for processing a silver halide light sensitive photographic material, wherein the composition is manufactured by a stirring granulation method comprising a stirring granulation process, and at least part of said stirring granulation process is performed under the temperature condition of 35° C. to 120° C.

2. The method for manufacturing the solid processing composition of item 1, wherein the content of the added solution in the stirring granulation process is 0.01 to 2.0 weight % of the total weight of said solid processing composition.

3. The method for manufacturing the solid processing composition of item 1, wherein not less than 60% of the total weight of said solid processing composition has particle diameter of 1.0 $\mu$m to 150 $\mu$m.

4. The method for manufacturing the solid processing composition of item 1, wherein the composition contains reductone derivative represented by the following formula (1):

formula (1)

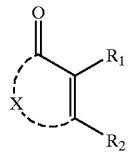

wherein $R_1$ and $R_2$ independently represent a hydroxy group, an amino group, an acylamino group, an alkylsulfonylamino group, an arylsulfonylamino group, an alkoxycarbonylamino group, a mercapto group or an alkylthio group; and X represents an atomic group necessary to form a 5- or 6-membered ring.

5. The method for manufacturing the solid processing composition of item 1, wherein the composition contains at least one kind of sugar and the compound represented by the following formula (2):

$$HO—(A_1—O)m_1—(A_2—O)m_2—(A_3—O)m_3—H \qquad \text{formula (2)}$$

wherein $A_1$, $A_2$ and $A_3$ independently represent a substituted or an unsubstituted straight or branched alkyl group and these may be the same or different, $m_1$, $m_2$ and $m_3$ independently represent an integer of 0 to 500, provided with $m_1+M_2+m_3 \geqq 5$.

6. The method for manufacturing the solid processing composition described in item 3, wherein the solid processing composition is molded as a tablet form by compression molding method.

Next, the invention will be explained in detail.

The solid processing composition of the invention is manufactured by using a stirring granulation process. The following is the explanation for the granulation in the invention.

The granulation is identified with manufacturing the grains which have approximately unified shape and size made from powdery, massive, and liquid raw materials. As for the granulating processes, it is possible to use any of the well known processes such as the process of a rolling granulation, an extrusion granulation, a compression granulation, a pulverizing granulation, a stirring granulation, a fluidized bed granulation and a spray-drying granulation, wherein the method for manufacturing the solid processing composition of the invention is the stirring granulation method.

The stirring granulation method is the method to utilize the agglomeration property of powder and this method is excellent in mixing ability. According to this method, the granulation is performed by stirring powder as a raw material and a small amount of solution with stirring blade in a fixed vessel.

At least part of the stirring granulation process is performed under the atmosphere of 35° C. to 120° C., preferably 50° C. to 90° C. Furthermore, it is preferable that the atmosphere is kept during stirring.

The stirring granulation process comprises at least 3 steps which are, (1) mixing ingredients for composition, (2) granulating by pouring solution, and (3) stirring the mixture after pouring. The time required to perform part of the stirring granulation process is 0.5 minute to 180 minutes, preferably 3.0 minutes to 90 minutes, especially preferably 10 minutes to 60 minutes.

As for the method to maintain the atmosphere of not less than 35° C., it is preferable to adjust the stirring heat generated in high speed stirring. Furthermore, it is preferable to circulate the warm water or warm oil through the jacket fixed beforehand around the mixing vessel of stirring granulation machine, and it is also preferable to adjust the temperature by changing air pressure in the vessel shut tightly. It is preferable that the temperature in the vessel is measured periodically by equipping the thermometer such as a thermoelectric thermometer.

As for the solution added in the stirring granulation process, the solution means not only water and organic solvents but also the solution made from binder dissolved in water or organic solvents.

In this invention, the amount of the solution added in the stirring granulation process is 0.01 to 2.0 weight % of the total weight of the solid processing composition of the invention, preferably 0.05 to 1.5 weight %, more preferably 0.1 to 1.0 weight %.

In the manufacturing process of the solid processing composition of the invention, mixing, pulverizing, and granulating of raw materials used for photographic processing agents is performed in only one process, and this process is performed in granulation mixing vessel. Other processes such as drying process and dressing process are omitted. According to this method, the manufacturing cost can be largely reduced.

Accordingly, one to a few specified raw materials used for photographic processing agents are added into the mixing vessel and stirred for mixing, thereafter, by keeping stirring, the granulation is performed adding the solution.

The solution can be poured during stopping stirring in the mixing vessel. However, from the viewpoint of unified dispersion of the solution, it is preferable to pour the solution during stirring.

Depending on the kind of raw materials used for photographic processing agents, the time required to stir for mixing is preferably 3 seconds to 120 minutes, more preferably 10 seconds to 60 minutes, especially preferably 30 seconds to 30 minutes.

The time required to pour the solution is 1 second to 30 minutes, preferably 10 seconds to 15 minutes, more preferably 30 seconds to 5 minutes. It is preferable to keep stirring to facilitate granulation after pouring the solution represented by water.

Stirring time after pouring the solution is 30 seconds to 90 minutes, preferably 1 minute to 60 minutes, more preferably 5 minutes to 30 minutes.

Preferably not less than 60% of the total weight of the solid processing composition of the invention is occupied after granulation process with solid grains whose particle diameter is 0.1 μm to 150 μm, more preferably, not less than 70%, furthermore preferably, not less than 80% of the total weight of the solid processing composition of the invention is occupied with solid grains whose particle diameter is 0.1 μm to 150 μm.

As for the method of measuring the particle diameter of the solid grains, it is possible to use any of the well-known method such as the method of a sieve analysis, a microscopic analysis, a call-counter analysis, a sedimentation analysis, a centrifuge analysis, a wind-sieve analysis, a diffusion analysis, an adsorption analysis and a transmission analysis. The particle diameter is measured with the sieve analysis in this invention and means an average particle diameter obtained by calculating particle distribution measured with this sieve analysis.

The bulk density of the solid processing composition of the invention is preferably 0.05 g to 2.0 g/cm$^3$, more preferably 0.1 g to 1.5 g/cm$^3$.

As for the structure of stirring granulation machine, it has preferably a rotating axis protruded from the bottom of the mixer and stirring blade is equipped around the axis. The preferable number of the stirring blade is one to ten, more preferable two to five. As for the useful stirring blades, they are usually available on the market and can be easily obtained.

The rotation rate of the stirring blades is 50 to 5000 rpm, preferably 100 to 3000 rpm, more preferably 300 to 2000 rpm.

Hereinafter, reductone derivative included in the solid processing composition of the invention is explained in detail.

In formula (1), $R_1$ and $R_2$ independently represent a hydroxy group, an amino group (for example, an ethyl group, a n-butyl group, a hydroxyethyl group, and the other alkyl group having 1 to 10 carbon atoms as a substituent on this amino group), an acylamino group (for example, an acetylamino group, a benzoylamino group), an alkylsulfonylamino group (for example, a methanesulfonylamino group), an arylsulfonylamino group (for example, a benzenesulfonylamino group, a p-toluenesulfonylamino group), an alkoxycarbonylamino group (for example, a methoxycarbonylamino group), a mercapto group or an alkylthio group (for example, a metylthio group, an etylthio group). $R^1$ and $R^2$ are preferably a hydroxy group, an amino group, an alkylsulfonylamino group, an arylsulfonylamino group. X represents an atomic group necessary to form a 5- or 6-membered ring, preferably consists of a carbon atom, an oxygen atom or a nitrogen atom. X and vinyl group on which $R_1$ and $R_2$ substitute and carbonyl group can together form a 5- or 6-membered ring. For example, X represents —O—, —C($R_3$)($R_4$)—, —C($R_5$)=, —C(=O)—, —N($R_6$)—, —N= and two or three groups of these representative groups are needed to form a 5- or 6-membered ring together with vinyl group on which $R^1$ and $R^2$ substitute and carbonyl group.

Wherein $R_3$, $R_4$, $R_5$ and $R_6$ independently represent a hydrogen atom, an alkyl group having 1 to 10 carbon atoms which can be substituted (for example, a hydroxy group, a carboxy group, a sulfo group as a substituent), a hydroxy group and a carboxy group. Further, this 5- or 6-membered ring may form a saturated and an unsaturated fused ring.

The example of the 5- or 6-membered ring includes a dihydrofuranone ring, a dihydropyrone ring, a piranone ring, a cyclopentenone ring, a cyclohexenone ring, a pyrrolinone ring, a pyrazolinone ring, a pyridone ring, an azacyclohexenone ring and an uracil ring, and the preferable are a dihydrofuranone ring, a cyclopentenone ring, a cyclohexenone ring, a pyrazolinone ring, an azacyclohexenone ring or an uracil ring.
Further, the compound represented by formula (1) can form salts with lithium, sodium, potassium and ammonium.
The example of the compound represented by formula (1) in the invention is listed below, but is not limited thereto.
1-1
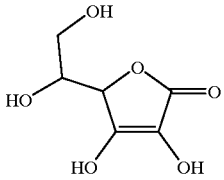
1-2
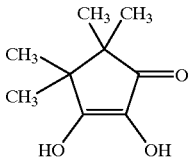
1-3
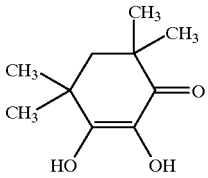
1-4
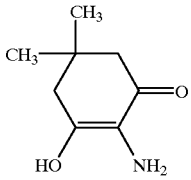
1-5
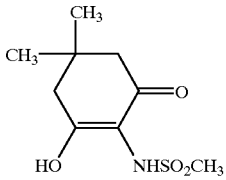
1-6
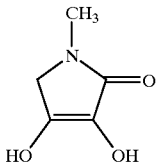
1-7
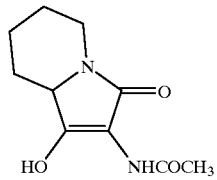
-continued
1-8
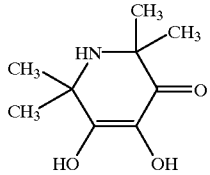
1-9
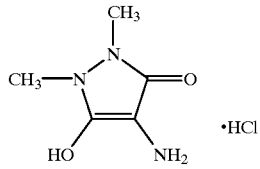
1-10
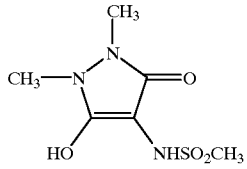
1-11
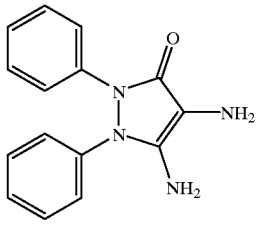
1-12
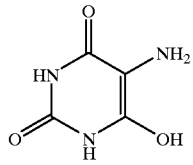
1-13
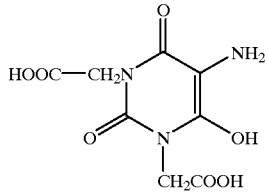
1-14
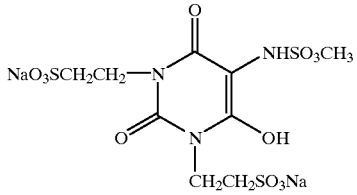
1-15
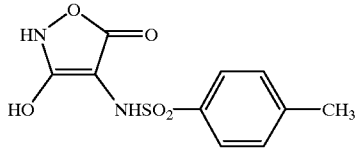

-continued 1-16

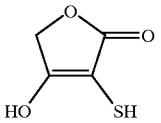

1-17

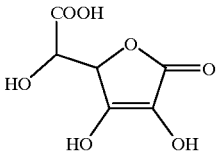

1-18

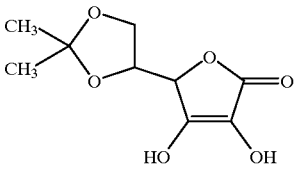

1-19

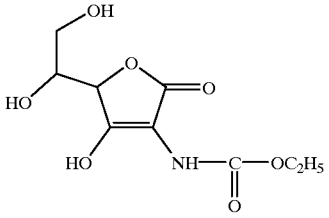

1-20

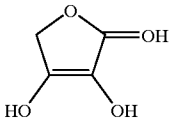

1-21

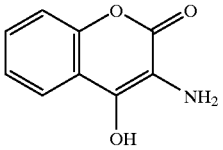

1-22

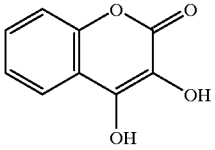

The especially preferable compounds in the exemplified compounds described above are ascorbic acid and erythorbic acid (steric isomers).

The solid developing composition of the invention contains the compound represented by formula (1) in an amount of preferably 20 to 99 weight %, and more preferably 30 to 90 weight %.

An amount of these reductone derivatives added into the processing solution for exposed material is 0.1 to 100 g per liter for practical use, and 0.5 to 70 g per liter is preferable to prevent the formation of white precipitation.

As for the preferable particle diameter of the reductone derivatives represented by formula (1) as a raw material before stirring, not less than 60% of the total weight of the reductone derivative has the particle diameter of 150 $\mu$m to 1000 $\mu$m, more preferably not less than 70% of the total weight of the reductone derivatives has the particle diameter of 150 $\mu$m to 600 $\mu$m, especially preferably, not less than 80% of the total weight of the reductone derivatives has the particle diameter of 150 $\mu$m to 300 $\mu$m.

The solid processing composition of the invention preferably contains at least one kind of sugar derivative and/or the compound represented by formula (2) in an amount of preferably 0.5 to 30 weight % of the total weight of the solid processing composition, and especially preferably 3 to 20 weight %.

The sugar in this invention includes not only a monosaccharide and a polysaccharide which is obtained by forming glycosido-bonding of plural monosaccharides but also their decomposition compounds.

The monosaccharide is the generic name of the wide range of derivatives, including a polyhydroxyaldehyde, a polyhydroxyketone, their reduction derivatives, their oxidation derivatives, their deoxy derivatives, their amino derivatives and their thio derivatives. Most of sugars are represented by generic formula $C_nH_{2n}O_n$, and in this invention, monosaccharide is defined as not only the generic formula $C_nH_{2n}O_n$ but also the compound derived from this generic formula $C_nH_{2n}O_n$. Among them, preferable is a sugar alcohol having primary and secondary alcohol which is obtained by reducing aldehyde group and ketone group.

Polysaccharide includes a cellulose derivative, a starch derivative and a glycogen derivative. The cellulose derivative includes a cellulose ether derivative, wherein part or all of hydroxy groups of cellulose derivative are etherealized. The starch derivatives include dextrin derivatives which are various decompositions produced in the process of finally obtaining malt sugar through hydrolysis of the starch derivatives. It is preferable that the cellulose derivatives exist in the form of salts together with alkali metals from the viewpoint of solubility. Among these polysaccharide derivatives, a cellulose derivative, a dextrin derivative and a cyclodextrin derivative are preferably used, more preferably used is the cyclodextrin derivative.

The example of the monosaccharide derivative of the invention is listed below, but is not limited thereto.

Exemplified Compounds

B-(1) Glyceraldehyde
B-(2) Dihydroxyacetone
B-(3) D-Erythrose
B-(4) L-Erythrose
B-(5) D-Threose
B-(6) L-Threose
B-(7) D-Ribose
B-(8) L-Ribose
B-(9) D-Arabinose
B-(10) L-Arabinose
B-(11) D-Xylose
B-(12) L-Xylose
B-(13) D-Lyxose
B-(14) L-Lyxose
B-(15) D-Xylulose
B-(16) L-Xylulose
B-(17) D-Ribulose
B-(18) L-Ribulose
B-(19) 2-Deoxy-D-ribose
B-(20) D-Allose
B-(21) L-Allose
B-(22) D-Altrose
B-(23) L-Altrose
B-(24) D-Glucose
B-(25) L-Glucose
B-(26) D-Mannose
B-(27) L-Mannose
B-(28) D-Gurose B-(29) L-Gurose
B-(30) D-Idose
B-(31) L-Idose
B-(32) D-Galactose
B-(33) L-Galactose
B-(34) D-Talose
B-(35) L-Talose
B-(36) D-Quinovose
B-(37) Digitalose
B-(38) Digitoxose
B-(39) Cymarose
B-(40) D-Sorbose
B-(41) L-Sorbose
B-(42) D-Tagatose
B-(43) D-Fucose
B-(44) L-Fucose
B-(45) 2-Deoxy-D-glucose
B-(46) D-Psicose
B-(47) D-Fructose
B-(48) L-Fructose
B-(49) L-Rhamnose
B-(50) D-Glucosamine
B-(51) D-Galactosamine
B-(52) D-Mannosamine
B-(53) D-Glycero-D-galacto-heptose
B-(54) D-Glycero-D-manno-heptose
B-(55) D-Glycero-L-manno-heptose
B-(56) D-Glycero-D-gulo-heptose
B-(57) D-Glycero-D-ido-heptose
B-(58) D-Glycero-L-gluco-heptose
B-(59) D-Glycero-L-talo-heptose
B-(60) D-Altro-heptulose
B-(61) D-Manno-heptulose
B-(62) D-Altro-3-heptulose
B-(63) D-Glucuronic acid
B-(64) L-Glucuronic acid
B-(65) N-Acetyl-D-glucosamine
B-(66) Glycerin
B-(67) D-Threitol
B-(68) L-Threitol
B-(69) Erithritol
B-(70) D-Arabitol
B-(71) L-Arabitol
B-(72) Adonitol
B-(73) Xylitol
B-(74) D-Sorbitol
B-(75) L-Sorbitol
B-(76) D-Mannitol
B-(77) L-Mannitol
B-(78) D-Iditol
B-(79) L-Iditol
B-(80) D-Talitol
B-(81) L-Talitol
B-(82) Dulcitol
B-(83) Allodulcitol Among these exemplified compounds, as preferable sugar alcohols, there can be compounds B-(66) to (83), as more preferable sugar alcohols, there can be compounds B-(69) and compounds (74) to (83).

The example of the polysaccharide derivative of the invention is listed below, but is not limited thereto.

Exemplified Compounds

C-(1) Malt sugar
C-(2) Cellobiose
C-(3) Trehalose
C-(4) Gentiobiose
C-(5) Isomaltose
C-(6) Lactose
C-(7) Raffinose
C-(8) Gentianose
C-(9) Stachyose
C-(10) Xylan
C-(11) Araban
C-(12) Glycogen
C-(13) Dextran
C-(14) Inulin
C-(15) Levan
C-(16) Galactan
C-(17) Agarose
C-(18) Amylose
C-(19) Sucrose
C-(20) Agarobiose
C-(21) Methylcellulose
C-(22) Di-methylcellulose
C-(23) Tri-methylcellulose
C-(24) Ethylcellulose
C-(25) Di-ethylcellulose
C-(26) Tri-ethylcellulose
C-(27) Carboxymethylcellulose
C-(28) Carboxyethylcellulose
C-(29) Aminoethylcellulose
C-(30) Hydroxymethylcellulose
C-(31) Hydroxyethylcellulose
C-(32) Hydroxypropylcellulose
C-(33) Hydroxypropylmethylcellulose
C-(34) Hydroxypropylmethylcelluloseacetatesuccinate
C-(35) Carboxymethylhydroxyethylcellulose
C-(36) α-Dextrin
C-(37) β-Dextrin
C-(38) γ-Dextrin
C-(39) δ-Dextrin
C-(40) ϵ-Dextrin
C-(41) α-Limiting-dextrin
C-(42) β-Limiting-dextrin
C-(43) Phosphorylase-limiting-dextrin
C-(44) Soluble starch
C-(45) Thin paste starch
C-(46) White dextrin
C-(47) Yellow dextrin
C-(48) British gum
C-(49) α-Cyclodextrin
C-(50) β-Cyclodextrin
C-(51) γ-Cyclodextrin
C-(52) Metyl-α-cyclodextrin
(53) Metyl-β-cyclodextrin
C-(54) Metyl-γ-cyclodextrin
C-(55) Hydroxypropyl-α-cyclodextrin
C-(56) Hydroxypropyl-β-cyclodextrin
C-(57) Hydroxypropyl-γ-cyclodextrin
C-(58) Maltcyclodextrin Some kinds of sugars exist naturally and widely and can be easily obtained from the market and their derivatives can be easily synthesized through reduction, oxidation or dehydration reaction.

Subsequently, the compound represented by formula (2) is explained in detail below:

$$HO—(A_1—O)m_1—(A_2—O)m_2—(A_3—O)m_3—H \qquad \text{formula (2)}$$

Wherein $A_1$, $A_2$ and $A_3$ independently represent a substituted, an unsubstituted straight or branched alkyl group and these may be the same or different.

As the substituents, there can be a hydroxy group, a carboxy group, a sulfonyl group, an alkoxy group, a carbamoyl group and a sulfamoyl group. It is preferable that each of $A_1$, $A_2$ and $A_3$ has no substituent and it is the most preferable that each of $A_1$, $A_2$ and $A_3$ is —$CH_2CH_2$— or —$CH(CH_3)$—$CH_2$—. $m_1$, $m_2$ and $m_3$ independently represent an integer of 0 to 500, provided with $m_1+m_2+m_3 \geqq 5$.

Among them, it is preferable that at least one of $m_1$, $m_2$ and $m_3$ is not less than 15, more preferable not less than 20.

In the case of that the compound represented by formula (2) is a copolymer obtained by copolymerization of monomer A and B, for example, the following dispositions are included.

-A-B-A-B-A-B-A-B-A-B-

-A-A-B-A-B-B-A-A-A-B-A-A-B-B-A-

-A-A-A-A-A-A-B-B-B-B-B -B-A-A-A-A-A-

Among these copolymers, the most preferable copolymer is a block-copolymer (trade name; Pluronic (nonionic surfactant)) represented by the following formula (2-1), which is obtained by the copolymerization of a etyleneglycol and a propyleneglycol.

$$HO—(CH_2CH_2—O)m_4—[CH(CH_3)CH_2—O]m_5—(CH_2CH_2—O)m_6—H \quad \text{Formula (2-1)}$$

Wherein $m_4$, $m_5$ and $m_6$ are synonymous with $m_1$, $m_2$ and $m_3$ respectively.

As to the compound represented by formula (2-1) of the invention, the content of ethylene oxide is preferably not less than 70 weight % of total weight of the copolymer, especially preferably not less than 80 weight % of total weight of the copolymer.

The example of the compounds represented by formula (2) and formula (2-1) of the invention is listed below, but is not limited thereto.

| $HO—(CH_2—CH_2—O)_{n'}—H$ | average molecular weight |
|---|---|
| 2-1 | 300 |
| 2-2 | 600 |
| 2-3 | 1000 |
| 2-4 | 1500 |
| 2-5 | 2000 |
| 2-6 | 3000 |
| 2-7 | 4000 |
| 2-8 | 6000 |
| 2-9 | 10000 |
| 2-10 | 15000 |
| 2-11 | 20000 |
| 2-12 | 30000 |

| $HO—(CH_2CH_2—O)_{a'}—[CH(CH_3)—CH_2—O]_{b'}—(CH_2CH_2—O)_{c'}—H$ | content of ethylene oxide | average molecular weight |
|---|---|---|
| 2-1-1 | 80 weight % | 8350 |
| 2-1-2 | 80 weight % | 10800 |
| 2-1-3 | 50 weight % | 4600 |
| 2-1-4 | 70 weight % | 6500 |
| 2-1-5 | 80 weight % | 5000 |
| 2-1-6 | 50 weight % | 3500 |
| 2-1-7 | 70 weight % | 7850 |
| 2-1-8 | 50 weight % | 4150 |

Wherein n' is an integer not less than 5 and a', b' and c' are synonymous with $m_1$, $m_2$ and $m_3$ respectively.

Among the compounds represented by formula (2) and formula (2-1) of the invention, most preferable is polyethylene glycol (abbreviated as PEG).

As to the polyethylene glycol, an average molecular weight of 2000 to 20000 is preferable, especially preferable is 3000 to 15000. The average molecular weight is the molecular weight obtained by calculating hydroxyl value.

With regard to using the compound represented by formula (2), the compound may be used singly or in combination.

The compound represented by following formula (3) is preferably contained in the solid processing composition of the invention.

$$R—(O)_XS_YO_ZM \quad \text{Formula (3)}$$

wherein R represents a substituted or an unsubstituted aliphatic group, an aromatic group or a heterocyclic ring group, X is 0 or 1, Y is 1 or 2, Z is 2 to 8, and M represents a cation.

In formula (3) above, as an aliphatic group represented by R is cited an alkyl group, an alkenyl group and an alkinyl group. As examples of alkyl group are cited methyl, ethyl, i-propyl, butyl, t-butyl, pentyl, cyclopentyl, hexyl, cyclohexyl, octyl, dodecyl. The above alkyl groups may be substituted by a halogen atom (a chlorine, bromine and fluorine atom), an alkoxy group (for example, methoxy, ethoxy, 1,1-dimetylethoxy, hexyloxy and dodecyloxy), an aryloxy group (for example, phenoxy and naphtyloxy), an aryl group (for example, phenyl and naphthyl), an alkoxycarbonyl group (for example, methoxycarbonyl, ethoxycarbonyl, butoxycarbonyl and 2-ethylhexylcarbonyl), an aryloxycarbonyl group (for example, phenoxycarbonyl and naphthyloxycarbonyl), an alkenyl group (for example, vinyl and allyl), a heterocyclic ring group (for example, 2-pyridyl, 3-pyridyl, 4-pyridyl, morphoryl, piperidyl, piperazyl, pyrimidyl, pyrazolinyl and furyl), an alkinyl group (for example, propargyl), an amino group (for example, amino, N,N-dimethylamino and anilino), a cyano group, a sulfonamido group (for example, methylsulfonylamino, ethylsulfonylamino, butylsulfonylamino, octylsulfonylamino and phenylsulfonylamino).

As examples of alkenyl group are cited a vinyl group and an allyl group. As example of alkinyl group is cited a propargyl group.

As examples of aromatic groups are cited a phenyl group and a naphthyl group. As examples of heterocyclic ring groups are cited a pyridyl group (for example, 2-pyridyl, 3-pyridyl and 4-pyridyl), a thiazolyl group, an oxazolyl group, an imidazolyl group, a furyl group, a thienyl group, a pyrrolyl group, a pyrazinyl group, a pyrimidinyl group, a pyridazinyl group, a selenazolyl, a suloforanyl group, a piperidinyl group, a pyrazolyl group and a tetrazolyl group.

These alkenyl group, alkinyl group, aromatic group and heterocyclic ring group mentioned above can be substituted by the same substituents as used for the alkyl group represented by R as explained above in detail.

As example of cation is cited a metal ion or an organic cation. As examples of metal ions are cited a lithium ion, a sodium ion and a potassium ion and as examples of organic cations are cited an ammonium ion (for example, ammonium ion, tetra-methylammonium ion and tetra-butylammonium ion), a phosphonium ion (for example, tetra-phenylphosphonium ion) and a guanidyl ion.

The compound represented by formula (3) can improve a sliding property of the solid processing composition of the invention when these compounds represented by formula (3) is added when molding a tablet by compression molding method.

The example of the compound represented by formula (3) is listed below, but is not limited thereto.

Exemplified Compounds $C_2H_5SO_3Na$ 3-1

$CH_3(CH_2)_6SO_3Na$ 3-2

$CH_3(CH_2)_7SO_3Na$ 3-3

$CH_3(CH_2)_5OSO_3Na$ 3-4

$CH_3(CH_2)_6OSO_3Na$ 3-5

$CH_3(CH_2)_7OSO_3Na$ 3-6

$CH_3(CH_2)_2SO_3Na$ 3-7

3-8

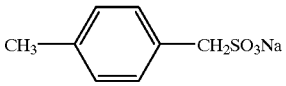

3-9

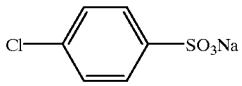

3-10

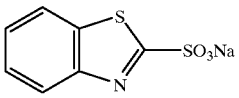

3-11

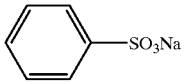

3-12

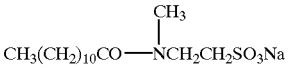

3-13

$CH_3(CH_2)_{11}SO_3Na$

The content of the compound represented by the above formula (3) added into the solid processing composition of the invention is preferably 0.01 to 5.0% of the total weight of the solid processing composition, more preferably 0.1 to 2.0%, especially preferably 0.5 to 2.0%.

The application of the solid processing composition obtained by the method of the invention to the solid developing composition is explained in detail below.

The tablet of developing agents used in this invention includes preferably reductone derivatives such as ascorbic acid and erythorbic acid (steric isomers).

Furthermore, the following developing agents may be included. The examples of them are dihydroxybenzene derivatives (for example, hydroquinone, clorohydroquinone, bromohydroquinone, diclorohydroquinone, iso-propyl hydroquinone, methylhydroquinone, 2,3-diclorohydroquinone, methoxyhydroquinone, 2,5-dimethylhydroquinone, potassium hydroquinone-monosulfonate, sodium hydroquinone-monosulfonate), 3-pyrazolidone derivatives (for example, 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, 1-phenyl-4-methyl-4-hydroxymethyl-3-pyrazolidone, 1-phenyl-4,4-hydroxymethyl-3-pyrazolidone, 1-p-tolyl-3-pyrazolidone, 1-phenyl-2-acetyl-4,4-dimethyl-3-pyrazolidone, 1-(2-benzthiazole)-3-pyrazolidone, 3-acetoxy-1-phenyl-3-pyrazolidone), aminophenol derivatives (for example, o-aminophenol, p-aminophenol, N-methyl-o-aminophenol, N-methyl-p-aminophenol, 2,4-diaminophenol), 1-aryl-3-aminopyrazoline derivatives (for example, 1-(p-hydroxyphenyl)-3-aminopyrazoline, 1-(p-methylaminophenyl)-3-aminopyrazoline, 1-(p-amino-m-methylphenyl)-3-aminopyrazoline), and pyrazolone derivatives (for example, 4-amino pyrazolone), and the mixture of these derivatives.

The developer tablet preferably contains sulfite and/or metabisulfite. The amount of sulfite when the developing tablet is dissolved in water to provide a developing solution is 0.05 to 0.3 mol per liter, preferably 0.1 to 0.3 mol per liter.

The developer tablet may contain buffer agents (for example, carbonate, boric acid, borate and alkanol amine), alkaline agents, auxiliary solubilizing agents (for example, polyethylene glycol derivatives and their ether derivatives), pH adjusting agents (for example, organic acids such as citric acid), sensitizers (for example, quaternary ammonium salts), developing accelerators, hardeners (for example, dialdehyde derivatives such as glutaraldehyde), surfactants, organic antifoggants (for example, azole compounds such as indazole compounds, imidazole compounds, benzimidazole compounds, triazole compounds, benztriazole compounds, tetrazole compounds and thiadiazole compounds), and chelating agents to form chelation with calcium ion contained in city water (for example, sodium hexametaphosphate, calcium hexametaphosphate, polyphosphate salts and diethylenetriaminepentaacetic acid). Furthermore, the developer tablet may contain anti-silver stain agents such as described in Japanese Patent Publication Open to Public Inspection (hereinafter referred to as Japanese Patent O.P.I. Publication) No.56-24347/1981.

The pH of the developing solution obtained from the developer tablet is preferably not more than 10.5, more preferably 9.0 to 10.0.

The developing solution obtained from the developer tablet may contain an amino derivative such as alkanol amine described in Japanese Patent O.P.I. Publication No.56-106244/1981.

Besides, the developing solution obtained from the developer tablet may contain the various agents described in "Photographic Processing Chemistry", written by L. F. A. Mason published by Focal Press Ltd. in 1966, pp. 22–229, and U.S. Pat. Nos. 2,193,015 and 2,592,364, and Japanese Patent O.P.I. Publication No.48-64933/1973.

As a preferable alkaline agent is cited a carbonate which has a buffering activity. The examples of the carbonates are potassium carbonate, sodium carbonate and lithium carbonate and the amount of the carbonate in developing solution is preferably 0.3 to 0.8 mol per liter.

The fix solution is explained below.

It is preferable to prepare the fix solution by adjusting and dissolving the solid fixing composition. As a main fixing agent, a thiosulfate salt is preferably contained. The embodiments of thiosulfate salts are salts of a lithium thiosulfate, a potassium thiosulfate, a sodium thiosulfate and an ammonium thiosulfate, preferably used are the ammonium thiosulfate and the sodium thiosulfate which can facilitate the fixing rate.

Besides, as main fixing agents, an iodide salt and a thiocyanide can be used. The fix solution contains a sulfite. As the sulfite, are used a lithium sulfite, a potassium sulfite, a sodium sulfite and an ammonium sulfite.

The fix solution can contain an aqueous soluble chromium salt and a aqueous soluble aluminum salt. The example of the aqueous soluble chromium salt is a chromium alum and the examples of the aqueous soluble aluminum salt are an aluminum sulfate and a potassium aluminum chloride and an aluminum chloride.

The fix solution used in this invention can preferably contain compounds consisting of an acetic acid ion such as an acetic acid, a lithium acetate, a potassium acetate, a sodium acetate and an ammonium acetate. The sodium acetate and ammonium acetate are more preferably used.

Furthermore, the fix solution can contain a citric acid, a tartaric acid, a malic acid, a succinic acid and a phenylacetic acid and their optical isomers.

The salts of these acids are preferably the salts obtained with lithium, potassium, sodium and ammonium. The examples of these salts are a potassium citrate, a sodium citrate, an ammonium citrate, a lithium hydrogentartrate, a potassium hydrogentartrate, a potassium tartrate, s sodium hydrogentartrate, a sodium tartrate, an ammonium hydrogentartrate, a potassium ammonium tartrate, a potassium sodium tartrate, a sodium malate, an ammonium malate, a sodium succinate and an ammonium succinate.

Among the compounds mentioned above, more preferable are citric acid, iso-citric acid, malic acid and phenyl acetic acid and their salts. As the other acids are cited not only inorganic acids such as sulfuric acid, hydrochloric acid, nitric acid and boric acid, but also organic acids such as formic acid, propionic acid, oxalic acid and malic acid, preferable are boric acid and aminipolycarboxylic acid and their salts.

As for chelating agents, are cited aminopolycarboxylic acids such as nitrilotriacetic acid and ethylenediaminetetraacetic acid.

As for surfactants, are cited anion surfactants such as sulfuric esterified compound and sulfonated compound, non- ionic surfactants such as polyethyleneglycol and esterified compound, and amphoteric surfactants. As for wetting agents, are cited alkanol amine and alkyleneglycol.

As for fix accelerating agents, are cited thiourea derivatives and alcohol derivatives having triple bond in their molecules and thioether derivatives.

The pH of fix solution is not less than 3.8, preferably 4.2 to 5.5.

The amount of replenisher of both developing solution and fixing solution related to this invention is preferably not more than 20 ml per 10×12 inch$^2$ size from the viewpoint of the reduction of the waste solution, more preferably not more than 15 ml per 10×12 inch$^2$ size.

EXAMPLES

The examples of the invention will be explained below, but the invention is not limited thereto.

Example 1

Preparation of the Solid Processing Composition for Developing Solution

As the stirring granulation machine, Henschel mixer FM20C/I type produced by Mitsui Mining Co., Ltd. whose maximum capacity was 20 liter, was used. Two stirring blades were equipped.

As the lower blade near the bottom mixing vessel, Ao type (for general use) was equipped, and as the upper blade, Zo type (for kneading use) was equipped. The temperature in the mixing vessel was adjusted by circulating warm water set up as described in Table 1 and 2 through the jacket surrounding the mixing vessel of Henschel mixer.

The temperature adjusted in the granulation process was shown in Table 1 and 2.

| [Preparation of solid developer composition] | |
|---|---|
| (1) Compound represented by formula (1) | 1700 g (see Table 1, 2) |

-continued

| [Preparation of solid developer composition] | |
|---|---|
| (2) Sodium metabisulfite | 500 g |
| (3) 1-Phenyl-3-pyrazolidone | 150 g |
| (4) N-Acetyl-D,L-penicillamine | 5 g |
| (5) Glutaraldehyde-bisodiumsulfite | 200 g |
| (6) Sugar derivative | 250 g (see Table 1, 2) |
| (7) Compound represented by formula (3) | 28 g (see Table 1, 2) |

Granulation

The granulation was performed by changing the combination of above-mentioned processing agents (1) to (7) as shown in Table 1 and 2. First, the processing agents (1) to (6) were added into the mixing vessel as shown in Table 1 and 2. Hereinafter, the granulation process of the invention was divided as follows for convenience.

Process A: stirring mixture.

Process B: granulation process by pouring water.

Process C: stirring mixture to facilitate granulation still more.

By dividing the granulation process into these three processes, the powdery granule was produced under the condition shown in Table 1 and 2. In the case of temperature difference between the above-mentioned processes, next process is performed after adjusting the temperature of the jacket water. Furthermore, the compound (7), which is represented by formula (3), was added into the mixing vessel after finishing the process C, and was stirred still more 30 seconds.

The rotation rate of the stirring blades was 600 rpm in the process A, 1800 rpm in the process B, and 600 rpm in the process C.

Water was dropped into the mixing vessel constantly by using a pipette for time set up in the process B shown in Table 1 and 2.

Measurement of Particle Diameter of the Powdery Granule

The particle distribution was measured by using both micro electromagnetic vibration sieve M-100 produced by Tsutsui Rikagakukikai Co., Ltd. and sieve analysis with mesh standardized by Japanese Industrial Standard (JIS). The vibration time was 5 minutes.

Producing Tablet

The obtained powdery granules were tableted in an amount per tablet of 10 g, using the tableting machine which was improved type of the rotary tableting machine such as Tough Press Correct Model 1527HU produced by Kikusui Seisakusho Co., Ltd. The cylindrical developer tablet with the diameter of 30 mm was obtained.

Evaluation of Tablet Hardness

Each of several groups consisting of twenty fresh developer tablets containing the same ingredients was prepared. The hardness of these fresh developer tablets obtained by the above method was measured by using a hardness measuring machine (TS-75NL produced by Okada Seikosha Co., Ltd.), and an average value of the hardness of each of several groups consisting of twenty tablets was defined as the hardness of tablet in this invention. The larger hardness of tablet expresses an excellent tablet and more than 35 kg of hardness is a preferable hardness for practical use.

Evaluation of Tablet Storage Hardness

Each of several groups consisting of twenty tablets was enclosed in a moistureproof bag made from polyethylene terephthalate which was vacuum-evaporated by aluminum.

Each bag was allowed to stand under the high constant temperature 50° C. for 30 days, and to check up the heat resistance of the tablet, the hardness of these tablets preserved under the high constant temperature was evaluated in the similar manner as used in evaluating the hardness of fresh tablets mentioned above.

The results thereof will be shown collectively in Table 1 and 2.

TABLE 1

| No. | Formula (1) Compound | Sugar | Formula (3) Compound | Process B amount of water (wt %) | Process A Temp. (° C.) | Process A Time (min.) | Process B Temp. (° C.) | Process B Time (min.) | Process C Temp. (° C.) | Process C Time (min.) | Particle diameter not more than 150 μm (wt %) | Tablet hardness (kg) | Tablet hardness after storage (kg) | Remarks |
|---|---|---|---|---|---|---|---|---|---|---|---|---|---|---|
| 1 | Sodium erythorbate | D-Sorbitol | Sodium 1-hexanesulfonate | 0.5 | 25 | 1.0 | 25 | 5.0 | 25 | 10.0 | 89 | 12 | 5 | Comp. |
| 2 | Sodium erythorbate | D-Sorbitol | Sodium 1-hexanesulfonate | 0.5 | 50 | 1.0 | 25 | 5.0 | 25 | 10.0 | 83 | 35 | 39 | Inv. |
| 3 | Sodium erythorbate | D-Sorbitol | Sodium 1-hexanesulfonate | 0.5 | 25 | 1.0 | 50 | 5.0 | 25 | 10.0 | 75 | 43 | 45 | Inv. |
| 4 | Sodium erythorbate | D-Sorbitol | Sodium 1-hexanesulfonate | 0.5 | 25 | 1.0 | 25 | 5.0 | 50 | 10.0 | 80 | 50 | 85 | Inv. |
| 5 | Sodium erythorbate | D-Sorbitol | Sodium 1-hexanesulfonate | 0.5 | 25 | 3.0 | 25 | 5.0 | 25 | 10.0 | 81 | 12 | 5 | Comp. |
| 6 | Sodium erythorbate | D-Sorbitol | Sodium 1-hexanesulfonate | 0.5 | 50 | 3.0 | 25 | 5.0 | 25 | 30.0 | 80 | 35 | 45 | Inv. |
| 7 | Sodium erythorbate | D-Sorbitol | Sodium 1-hexanesulfonate | 0.5 | 25 | 3.0 | 50 | 5.0 | 25 | 30.0 | 64 | 42 | 45 | Inv. |
| 8 | Sodium erythorbate | D-Sorbitol | Sodium 1-hexanesulfonate | 0.5 | 25 | 3.0 | 25 | 5.0 | 50 | 30.0 | 70 | 55 | 94 | Inv. |
| 9 | Sodium erythorbate | D-Sorbitol | Sodium 1-hexanesulfonate | 0.5 | 60 | 1.0 | 25 | 5.0 | 25 | 30.0 | 77 | 36 | 48 | Inv. |
| 10 | Sodium erythorbate | D-Sorbitol | Sodium 1-hexanesulfonate | 0.5 | 25 | 1.0 | 60 | 5.0 | 25 | 30.0 | 66 | 45 | 50 | Inv. |
| 11 | Sodium erythorbate | D-Sorbitol | Sodium 1-hexanesulfonate | 0.5 | 25 | 1.0 | 25 | 5.0 | 60 | 30.0 | 80 | 59 | 95 | Inv. |
| 12 | Sodium erythorbate | D-Sorbitol | Sodium 1-hexanesulfonate | 0.5 | 25 | 1.0 | 25 | 5.0 | 70 | 30.0 | 73 | 60 | 100 | Inv. |
| 13 | Sodium erythorbate | D-Sorbitol | Sodium 1-hexanesulfonate | 0.5 | 25 | 1.0 | 25 | 5.0 | 85 | 30.0 | 70 | 62 | 104 | Inv. |
| 14 | Sodium erythorbate | D-mannitol | Sodium 1-hexanesulfonate | 0.5 | 25 | 1.0 | 25 | 5.0 | 25 | 30.0 | 90 | 13 | 5 | Comp. |

Comp.: Comparison, Inv.: Invention

TABLE 2

| No. | Formula (1) Compound | Sugar | Formula (3) Compound | Process B amount of water (wt %) | Process A Temp. (° C.) | Process A Time (min.) | Process B Temp. (° C.) | Process B Time (min.) | Process C Temp. (° C.) | Process C Time (min.) | Particle diameter not more than 150 μm (wt %) | Tablet hardness (kg) | Tablet hardness after storage (kg) | Remarks |
|---|---|---|---|---|---|---|---|---|---|---|---|---|---|---|
| 15 | Sodium erythorbate | D-mannitol | Sodium 1-hexanesulfonate | 0.5 | 25 | 1.0 | 25 | 5.0 | 33 | 30.0 | 87 | 15 | 10 | Comp. |
| 16 | Sodium erythorbate | D-mannitol | Sodium 1-hexanesulfonate | 0.5 | 25 | 1.0 | 25 | 5.0 | 33 | 60.0 | 84 | 18 | 11 | Comp. |
| 17 | Sodium erythorbate | D-mannitol | Sodium 1-hexanesulfonate | 0.5 | 25 | 1.0 | 25 | 5.0 | 39 | 60.0 | 72 | 40 | 56 | Inv. |

TABLE 2-continued

| No. | Formula (1) Compound | Sugar | Formula (3) Compound | Process B amount of water (wt %) | Process A Temp. (° C.) | Process A Time (min.) | Process B Temp. (° C.) | Process B Time (min.) | Process C Temp. (° C.) | Process C Time (min.) | Particle diameter not more than 150 μm (wt %) | Tablet hardness (kg) | Tablet hardness after storage (kg) | Remarks |
|---|---|---|---|---|---|---|---|---|---|---|---|---|---|---|
| 18 | Sodium erythorbate | D-mannitol | Sodium 1-hexanesulfonate | 1.8 | 25 | 1.0 | 25 | 5.0 | 39 | 60.0 | 67 | 45 | 63 | Inv. |
| 19 | Sodium erythorbate | D-mannitol | Sodium 1-hexanesulfonate | 0.5 | 25 | 1.0 | 25 | 5.0 | 50 | 30.0 | 72 | 50 | 83 | Inv. |
| 20 | Sodium erythorbate | D-mannitol | Sodium 1-hexanesulfonate | 0.5 | 25 | 1.0 | 25 | 5.0 | 60 | 30.0 | 75 | 55 | 88 | Inv. |
| 21 | Sodium erythorbate | D-mannitol | Sodium 1-hexanesulfonate | 0.5 | 25 | 1.0 | 25 | 5.0 | 70 | 30.0 | 75 | 59 | 90 | Inv. |
| 22 | Sodium erythorbate | D-mannitol | Sodium 1-hexanesulfonate | 0.5 | 25 | 1.0 | 25 | 5.0 | 85 | 30.0 | 77 | 64 | 97 | Inv. |
| 23 | Sodium erythorbate | D-mannitol | Sodium 1-hexanesulfonate | 0.1 | 25 | 1.0 | 25 | 5.0 | 60 | 30.0 | 87 | 46 | 53 | Inv. |
| 24 | Sodium erythorbate | D-mannitol | Sodium 1-hexanesulfonate | 1.0 | 25 | 1.0 | 25 | 5.0 | 60 | 30.0 | 75 | 52 | 85 | Inv. |
| 25 | Sodium erythorbate | D-mannitol | Sodium 1-hexanesulfonate | 1.8 | 25 | 1.0 | 25 | 5.0 | 60 | 30.0 | 64 | 70 | 47 | Inv. |
| 26 | Sodium erythorbate | D-mannitol | Sodium 1-hexanesulfonate | 3.0 | 25 | 1.0 | 25 | 5.0 | 60 | 30.0 | 48 | 82 | 32 | Inv. |
| 27 | Sodium erythorbate | D-Sorbitol | Sodium 1-octanesulfonate | 0.5 | 25 | 1.0 | 25 | 5.0 | 60 | 30.0 | 77 | 59 | 103 | Inv. |
| 28 | Sodium erythorbate | D-Sorbitol | Sodium 1-octanesulfonate | 1.8 | 25 | 1.0 | 25 | 5.0 | 60 | 30.0 | 65 | 65 | 115 | Inv. |

Comp.: Comparison, Inv.: Invention

As is obvious from the results shown in Table 1 and 2, it can be found that every solid processing composition sample of the invention has an excellent tablet hardness.

Example 2

Polyethylene glycol (PEG) represented by formula (2) was added into the solid developer composition of example 1 and the tablet of the solid developer composition was prepared in the similar manner as described in example 1. The resulted tablet samples were evaluated in the similar manner as described in example 1. The solubility of the tablet was evaluated by following method.

Evaluation of Tablet Solubility

Each of several groups consisting of six tablets containing the same ingredients was prepared and dissolved in a liter of warm water of 30° C. maintained constantly using magnetic stirrer. The time between adding each group of six tablets into a liter of warm water of 30° C. and complete dissolution of all the six tablets checked up by a visual observation was measured.

The results thereof will be shown in Table 3.

TABLE 3

| No. | Compound (PEG) of Formula (2) Average molecular weight | Compound (PEG) of Formula (2) Added position | Compound (PEG) of Formula (2) Added amount | Process B amount of water (wt %) | Process A Temp. (° C.) | Process A Time (min.) | Process B Temp. (° C.) | Process B Time (min.) | Process C Temp. (° C.) | Process C Time (min.) |
|---|---|---|---|---|---|---|---|---|---|---|
| 29 | — | — | — | 0.4 | 55 | 1 | 25 | 30 | 25 | 30 |
| 30 | 4000 | Process A | 75 | 0.4 | 55 | 1 | 25 | 30 | 25 | 30 |
| 31 | 4000 | Process B | 75 | 0.4 | 55 | 1 | 25 | 30 | 25 | 30 |
| 32 | 4000 | Process C | 75 | 0.4 | 55 | 1 | 25 | 30 | 25 | 30 |
| 33 | — | — | — | 0.4 | 25 | 1 | 55 | 30 | 25 | 30 |
| 34 | 4000 | Process A | 75 | 0.4 | 25 | 1 | 55 | 30 | 25 | 30 |
| 35 | 4000 | Process B | 75 | 0.4 | 25 | 1 | 55 | 30 | 25 | 30 |

TABLE 3-continued

| | | | | | | | | | | |
|---|---|---|---|---|---|---|---|---|---|---|
| 36 | 4000 | Process C | 75 | 0.4 | 25 | 1 | 55 | 30 | 25 | 30 |
| 37 | — | — | — | 0.4 | 25 | 1 | 25 | 30 | 55 | 30 |
| 38 | 4000 | Process A | 75 | 0.4 | 25 | 1 | 25 | 30 | 55 | 30 |
| 39 | 4000 | Process B | 75 | 0.4 | 25 | 1 | 25 | 30 | 55 | 30 |
| 40 | 4000 | Process C | 75 | 0.4 | 25 | 1 | 25 | 30 | 55 | 30 |
| 41 | 4000 | Process C | 75 | 0.1 | 25 | 1 | 25 | 30 | 55 | 30 |
| 42 | 4000 | Process C | 75 | 1.0 | 25 | 1 | 25 | 30 | 55 | 30 |
| 43 | 4000 | Process C | 75 | 1.8 | 25 | 1 | 25 | 30 | 55 | 30 |
| 44 | 4000 | Process C | 75 | 3.0 | 25 | 1 | 25 | 30 | 55 | 30 |
| 45 | 6000 | Process C | 75 | 0.5 | 25 | 1 | 25 | 30 | 55 | 30 |
| 46 | 6000 | Process C | 75 | 1.0 | 25 | 1 | 25 | 30 | 55 | 30 |
| 47 | 6000 | Process C | 75 | 1.8 | 25 | 1 | 25 | 30 | 55 | 30 |
| 48 | 6000 | Process C | 75 | 3.0 | 25 | 1 | 25 | 30 | 55 | 30 |

| No. | Particle diameter not more than 150 mm (wt %) | Tablet hardness (kg) | Tablet hardness after storage (kg) | Tablet Solubility (min.) | Remarks |
|---|---|---|---|---|---|
| 29 | 78 | 35 | 45 | 24.0 | Invention |
| 30 | 62 | 64 | 105 | 17.9 | Invention |
| 31 | 70 | 55 | 93 | 17.7 | Invention |
| 32 | 70 | 57 | 97 | 17.0 | Invention |
| 33 | 73 | 48 | 53 | 28.0 | Invention |
| 34 | 65 | 70 | 120 | 16.5 | Invention |
| 35 | 65 | 82 | 128 | 16.0 | Invention |
| 36 | 62 | 88 | 135 | 16.0 | Invention |
| 37 | 78 | 55 | 90 | 31.0 | Invention |
| 38 | 72 | 72 | 118 | 14.0 | Invention |
| 39 | 64 | 85 | 130 | 13.5 | Invention |
| 40 | 62 | 89 | 140 | 13.2 | Invention |
| 41 | 82 | 95 | 105 | 19.0 | Invention |
| 42 | 71 | 92 | 100 | 13.0 | Invention |
| 43 | 64 | 100 | 65 | 13.0 | Invention |
| 44 | 41 | 108 | 34 | 14.5 | Invention |
| 45 | 65 | 80 | 125 | 17.8 | Invention |
| 46 | 69 | 85 | 92 | 17.5 | Invention |
| 47 | 65 | 93 | 60 | 17.0 | Invention |
| 48 | 38 | 105 | 33 | 16.0 | Invention |

As is obvious from the results shown in Table 3, it can be found that the solid processing composition of the invention which is fresh or preserved under the high constant temperature of 50° C. for 30 days has an excellent tablet hardness, and it is also obvious that by adding polyethylene glycol derivatives into the solid processing composition of the invention, the solubility of the tablets is extremely increased and handling the tablets is improved when they are dissolved.

The following developing additives were added into the prescription of the solid developer composition used in Example 1, and then a developing solution of 50 liter was made by adding water.

| | |
|---|---|
| (1) Potassium carbonate | 4300 g |
| (2) Sodium diethylenetriaminepentaacetate | 85 g |
| (3) 3-(5-Mercaptotetrazole-1-yl)benzenesulfonic acid | 20 g |
| (4) Potassium iodide | 3 g |

The obtained developer was placed in the developing tank of a roller carrying automatic developing machine, SRX-201 (produced by Konica Corporation), and the rest of the developer was placed in an auxiliary tank. On the other hand, the fixing solution, TC-F1 (produced by Konica Corporation), was used. X-ray film SRG which was exposed to X-ray through the breast phantom was processed by this developing solution and this fixing solution. The total processing time was 60 seconds in terms of Dry to Dry. The results obtained by the above processing solutions showed similar photographic characteristics compared with the results obtained with current processing solutions.

The manufacturing cost of the solid processing composition of the invention can be reduced by 30% compared with the manufacturing cost of the current solid processing composition, because the manufacture of the solid processing composition of the invention does not include drying and dressing process.

What is claimed is:

1. A method for manufacturing a solid processing composition for processing a silver halide photographic light sensitive photographic material, wherein the composition is manufactured by a stirring granulation method comprising a stirring granulation process, and at least part of said stirring granulation process is performed under the temperature condition of 35° C. to 120° C.

2. The method for manufacturing the solid processing composition of claim 1, wherein the content of the added solution in the stirring granulation process is 0.01 to 2.0 weight % of the total weight of said solid processing composition.

3. The method for manufacturing the solid processing composition of claim 1, wherein not less than 60% of the total weight of said solid processing composition has particle diameter of 1.0 $\mu$m to 150 $\mu$m.

4. The method for manufacturing the solid processing composition of claim 1, wherein the composition contains reductone derivative represented by the following formula (1):

formula (1)

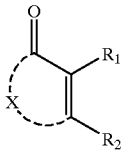

wherein $R_1$ and $R_2$ independently represent a hydroxy group, an amino group, an acylamino group, an alkylsulfonylamino group, an arylsulfonylamino group, an alkoxycarbonylamino group, a mercapto group or an alkylthio group; and X represents an atomic group necessary to form a 5- or 6-membered ring.

5. The method for manufacturing the solid processing composition of claim 1, wherein the composition contains at least one kind of sugar and the compound represented by the following formula (2):

$$HO—(A_1—O)m_1—(A_2—O)m_2—(A_3—O)m_3—H \quad \text{formula (2)}$$

wherein $A_1$, $A_2$ and $A_3$ independently represent a substituted or an unsubstituted straight or branched alkyl group and these may be the same or different, $m_1$, $m_2$ and $m_3$ independently represent an integer of 0 to 500, provided with $m_1+m_2+m_3 \geqq 5$.

6. The method for manufacturing the solid processing composition described in claim 3 wherein the solid processing composition is molded as a tablet form by compression molding method.

7. The method for manufacturing the solid processing composition of claim 1 wherein said stirring granulation process comprises the steps of stirring ingredients for the solid processing composition, granulating the ingredients by pouring a solution and stirring granulated mixture.

8. The method for manufacturing the solid processing composition of claim 7 wherein the time performed under the temperature is 30 seconds to 180 minutes.

9. The method for manufacturing the solid processing composition of claim 7 wherein the time for stirring the ingredients is 3 seconds to 120 minutes.

10. The method for manufacturing the solid processing composition of claim 7 wherein the time for pouring the solution is 1 second to 30 minutes during continuing to stir.

11. The method for manufacturing the solid processing composition of claim 7 wherein the time for stirring after pouring the solution is 30 seconds to 90 minutes.

12. The method for manufacturing the solid processing composition of claim 1 wherein said composition contains a compound represented by formula (3):

$$R(O)xSyOzM \quad \text{formula (3)}$$

wherein R represents an aliphatic group, an aromatic group or a heterocyclic ring group, x is 0, y is 1 or 2, z is 2 to 8, and M represent a cation.

13. The method for manufacturing the solid processing composition of claim 5 wherein the amount of at least one kind of said sugar and said compound represented by formula (2) is 0.5 to 30 weight % of the total weight of the solid composition.

14. The method of claim 1, wherein said solid processing composition is for fixing solution, the composition comprises a thiosulfate salt.

15. A method for manufacturing the solid processing composition for processing a silver halide photographic light sensitive material comprising a steps of stirring ingredients for the solid processing composition for 3 seconds to 120 minutes, granulating the ingredients by pouring a solution, wherein the time of pouring the solution is 1 second to 30 minutes continuing to stir and stirring granulated mixture for 30 seconds to 90 minutes, wherein at least part of the steps is performed under temperature of 35 to 120° C.

16. The method for manufacturing the solid processing composition of claim 15 wherein the amount of the solution poured is 0.01 to 2.0 weight % of the total weight of said solid processing composition.

17. The method of claim 16, wherein said solid processing composition is for developing the silver halide photographic light sensitive material, the composition comprises reductone derivative in an amount of 0.01 to 2.0 weight % of the total weight of said solid processing composition.

* * * * *